US012110678B2

(12) United States Patent
Recker et al.

(10) Patent No.: US 12,110,678 B2
(45) Date of Patent: Oct. 8, 2024

(54) REINFORCEMENT FOR A CONNECTOR IN A PRECAST CONCRETE PANEL

(71) Applicant: Meadow Burke, LLC, Riverview, FL (US)

(72) Inventors: Michael J. Recker, Palmetto, FL (US); Ronald G. Naumann, Valrico, FL (US); Kim E. Seeber, Lawrenceville, GA (US)

(73) Assignee: Meadow Burke, LLC, Riverview, FL (US)

( * ) Notice: Subject to any disclaimer, the term of this patent is extended or adjusted under 35 U.S.C. 154(b) by 333 days.

(21) Appl. No.: 17/371,675

(22) Filed: Jul. 9, 2021

(65) Prior Publication Data

US 2022/0010545 A1 Jan. 13, 2022

Related U.S. Application Data

(60) Provisional application No. 63/049,979, filed on Jul. 9, 2020.

(51) Int. Cl.

| | |
|---|---|
| ***E04B 1/41*** | (2006.01) |
| ***E04C 5/06*** | (2006.01) |
| *E04B 1/04* | (2006.01) |

(52) U.S. Cl.

CPC ..... *E04B 1/41* (2013.01); *E04C 5/06* (2013.01); *E04B 1/04* (2013.01); *E04B 2103/02* (2013.01)

(58) Field of Classification Search

CPC ..... E04B 1/41; E04B 2103/02; E04C 5/06

(Continued)

(56) References Cited

U.S. PATENT DOCUMENTS

| | | | |
|---|---|---|---|
| 693,127 | A | 2/1902 | Gardner et al. |
| 1,189,988 | A | 7/1916 | Moody |

(Continued)

FOREIGN PATENT DOCUMENTS

| | | |
|---|---|---|
| CA | 2063095 | 9/1993 |
| CA | 2776394 | 5/2012 |

(Continued)

OTHER PUBLICATIONS

U.S. Appl. No. 29/720,068, filed Jan. 9, 2020, Kelly et al.

(Continued)

*Primary Examiner* — Brian D Mattei
*Assistant Examiner* — Joseph J. Sadlon
(74) *Attorney, Agent, or Firm* — Sheridan Ross P.C.

(57) ABSTRACT

A reinforcement system is provided to strengthen a precast concrete panel with a connector that joins the panel with another structure such as a floor joist or concrete slab. One or more hook bars can be embedded in the panel proximate to the receiving member to distribute forces from the connector to a much larger volume of the panel. To accomplish this distribution, at least one hook bar can be positioned in an anchor volume defined by anchor members of the receiving member, and at least one hook bar can be positioned outside of the anchor volume. The hook bars can be oriented with a main body portion positioned proximate to the receiving member of the connector to resist tension forces caused by a load on the connector, and end portions of the at least one hook bar encompass the larger volume of the panel.

10 Claims, 10 Drawing Sheets

(58) Field of Classification Search
USPC ..... 52/582.1
See application file for complete search history.

(56) References Cited

U.S. PATENT DOCUMENTS 1,201,540 A 10/1916 Banes
1,327,711 A * 1/1920 Irving ..... E04B 1/41 52/509
1,551,432 A 8/1925 Schaeffer
1,616,444 A * 2/1927 Forkey ..... E04B 1/41 52/378
1,713,516 A * 5/1929 Beeker ..... E04B 1/41 52/713
1,729,935 A * 10/1929 Froehlich ..... E04B 1/4178 52/379
1,769,498 A 7/1930 Downing
1,831,565 A 11/1931 Jagger
2,053,873 A * 9/1936 Niederhofer ..... E04B 1/04 52/274
2,133,134 A 10/1938 Davis
2,218,894 A 10/1940 Schlosser
2,241,169 A * 5/1941 Yokes ..... E04B 1/12 52/262
2,303,544 A * 12/1942 Goss ..... E04B 1/41 52/351
2,336,604 A 12/1943 Edward et al.
2,355,651 A 8/1944 Hormes
2,477,735 A 8/1949 Gentile
2,595,111 A * 4/1952 Steward ..... A47G 27/0481 24/703.1
2,622,834 A 12/1952 Birger
2,660,050 A 11/1953 Hosbein et al.
2,681,786 A 6/1954 Birger
2,684,824 A 7/1954 Hillberg
2,832,559 A 4/1958 Hillberg
2,913,210 A 11/1959 Tichnor
2,940,603 A 6/1960 Riedmaier et al.
2,952,099 A * 9/1960 Futterer ..... E04B 1/41 52/27
2,967,692 A 1/1961 Isidore
3,085,693 A 4/1963 Shell
3,095,672 A 7/1963 Di Tullio et al.
3,109,260 A * 11/1963 De Cesare ..... E04B 1/41 52/441
3,171,627 A 3/1965 Tapley et al.
3,187,924 A 6/1965 William
3,229,950 A 1/1966 MacRobbie
3,266,202 A 8/1966 Stanley
3,273,847 A 9/1966 Berman
3,299,601 A * 1/1967 Chiville ..... E04B 1/41 52/315
3,303,627 A * 2/1967 Mora ..... E04C 5/06 52/840
3,360,898 A 1/1968 Beckman
3,471,988 A 10/1969 Allen
3,494,092 A * 2/1970 Bottjer ..... E04B 1/3538 52/236.7
3,537,671 A 11/1970 Wenthe
3,574,984 A * 4/1971 Chap ..... E04B 1/41 52/699
3,604,669 A 9/1971 Asher
3,613,900 A 10/1971 Chiu
3,628,762 A 12/1971 Williams et al.
3,637,086 A 1/1972 Klein
3,652,048 A 3/1972 Hartman
3,700,202 A 10/1972 Donnels
3,701,325 A 10/1972 Fenwick
3,737,131 A 6/1973 Larson
3,776,555 A 12/1973 Hagaman
3,788,026 A 1/1974 Cook
3,798,856 A 3/1974 Glaskowski
3,829,153 A 8/1974 Fussell, Jr. et al.
3,858,988 A 1/1975 Cohen
3,888,441 A 6/1975 Rebentisch
3,894,374 A * 7/1975 Faucheux ..... E04C 5/06 52/439
3,896,718 A 7/1975 Giambalvo
3,915,308 A 10/1975 Ratszloff et al.
3,954,243 A 5/1976 Sharp et al.
4,040,228 A 8/1977 Skubic
4,083,156 A 4/1978 Tye
4,085,556 A 4/1978 Sonneville
D254,290 S 2/1980 Smith
4,194,333 A 3/1980 Paton et al.
4,198,913 A 4/1980 Haworth et al.
4,378,925 A 4/1983 Griffin
4,403,700 A 9/1983 Manlove
4,528,915 A 7/1985 Cofer
4,532,740 A 8/1985 Fricker
4,569,173 A * 2/1986 Hultquist ..... E02D 27/01 52/294
4,588,866 A 5/1986 Monti
4,615,448 A 10/1986 Johnstonbaugh
4,648,739 A * 3/1987 Thomsen ..... E01C 11/14 404/49
4,659,054 A * 4/1987 Allen ..... E01C 19/2035 249/207
4,687,094 A 8/1987 Allsop et al.
D295,950 S 5/1988 Johnston
4,817,900 A 4/1989 Whittington et al.
4,835,933 A 6/1989 Yung
4,850,453 A 7/1989 St-Germain
4,872,634 A 10/1989 Gillaspy et al.
4,905,444 A 3/1990 Semaan et al.
4,946,099 A 8/1990 Bratchell
4,951,438 A 8/1990 Thoresen
5,038,689 A 8/1991 Duffy
5,114,127 A 5/1992 Everhart
5,150,553 A 9/1992 Commins et al.
5,154,388 A 10/1992 Magaro
5,185,971 A 2/1993 Johnson, Jr.
5,379,976 A 1/1995 Degirolamo
5,472,103 A 12/1995 Merl
5,548,939 A 8/1996 Carmical
5,671,582 A * 9/1997 Reay ..... E04B 1/164 52/432
5,711,122 A 1/1998 Lee
5,729,939 A * 3/1998 Di Benedetto ..... E04B 1/41 52/293.3
5,778,625 A 7/1998 Druffel et al.
5,829,207 A * 11/1998 Mackay Sim ..... E04G 21/142 52/125.4
5,881,519 A 3/1999 Newkirk
5,899,035 A 5/1999 Walkes et al.
5,943,830 A 8/1999 Truitt
6,019,331 A 2/2000 Hoogland et al.
6,058,672 A * 5/2000 McClellan ..... E04B 1/043 52/592.1
6,101,773 A 8/2000 Chau et al.
6,212,848 B1 4/2001 Cooper
6,223,916 B1 5/2001 Enos
6,233,893 B1 * 5/2001 Lewis ..... E04C 5/04 52/745.19
6,247,273 B1 6/2001 Nickel
6,273,435 B1 8/2001 Sringer
6,295,770 B1 * 10/2001 Sheu ..... E04C 5/04 52/649.3
6,298,631 B1 10/2001 Finley
6,494,639 B1 * 12/2002 Friend ..... E04B 1/215 403/360
6,499,608 B1 12/2002 Sterling et al.
6,546,684 B2 4/2003 Wallkes et al.
6,672,226 B2 1/2004 Bohnacker
6,854,222 B2 2/2005 Hansort
6,951,433 B2 10/2005 Reichel et al.
6,955,014 B2 * 10/2005 LeJeune ..... B28B 23/0025 52/223.6
D511,086 S 11/2005 Craine
D513,171 S 12/2005 Richardson
D521,851 S 5/2006 Smart
7,086,544 B1 8/2006 Doench

(56) References Cited

U.S. PATENT DOCUMENTS 7,254,925 B2 * 8/2007 Stefanutti ..... E02D 27/02 52/576
7,254,926 B2 * 8/2007 Eldeen ..... E04B 1/003 52/713
7,337,583 B1 3/2008 Lohman et al.
7,503,719 B1 * 3/2009 Ruel ..... E02D 29/0241 403/207
7,647,742 B2 * 1/2010 Han ..... E04B 1/34 52/741.1
7,681,366 B2 3/2010 De Gobbi
7,686,172 B2 3/2010 Wisnoski et al.
7,726,091 B2 6/2010 Frohlich et al.
7,793,450 B2 9/2010 Chasmer et al.
7,823,350 B2 * 11/2010 Valle ..... E04C 2/06 52/351
8,082,699 B1 * 12/2011 Kychelhahn ..... E04B 1/34853 52/79.9
8,186,645 B2 5/2012 Shaw et al.
8,209,924 B2 7/2012 Foley
8,209,925 B2 7/2012 Foley
8,359,797 B2 * 1/2013 Lee ..... E04B 5/023 249/19
8,365,484 B2 2/2013 Foley
8,468,764 B2 6/2013 Degen et al.
8,561,366 B2 10/2013 Gasperi
8,621,802 B2 * 1/2014 Spyrou ..... E04B 1/388 52/489.1
D701,107 S 3/2014 White
D706,321 S 6/2014 Oetlinger
8,746,633 B1 6/2014 Medlin, Jr.
8,826,605 B2 9/2014 Recker et al.
D715,339 S 10/2014 Oetlinger
8,850,763 B2 * 10/2014 Marsh ..... E04B 2/16 52/223.7
9,045,892 B2 * 6/2015 Smith ..... E04B 1/003
9,121,166 B2 * 9/2015 Amend ..... E04B 1/167
9,163,854 B2 10/2015 Arbucci
9,180,323 B2 * 11/2015 Borchardt ..... A62B 35/0068
9,277,814 B2 3/2016 Winker
9,315,998 B1 * 4/2016 Aral ..... E04C 5/122
9,326,602 B2 5/2016 Gupta
9,359,756 B2 * 6/2016 Hardy ..... E04B 1/2403
9,441,379 B2 * 9/2016 Stover ..... E04F 15/02044
9,458,619 B2 10/2016 Bowron et al.
D772,775 S 11/2016 Bird et al.
9,506,266 B2 * 11/2016 Foldenauer ..... E04H 12/14
9,528,271 B2 12/2016 Rook et al.
9,752,316 B2 * 9/2017 Thornton ..... E04B 1/16
9,803,354 B1 10/2017 Francies, III
9,845,595 B2 * 12/2017 Bowron ..... E04B 1/34326
9,874,008 B2 1/2018 Doupe et al.
9,879,422 B2 * 1/2018 Connell ..... E04B 2/8635
9,915,068 B2 * 3/2018 Kim ..... E01D 19/02
10,017,942 B2 * 7/2018 McCarthy ..... E04C 5/03
10,053,863 B2 * 8/2018 Fenske ..... E04B 1/4107
10,081,938 B2 9/2018 Acquistapace et al.
10,161,128 B2 * 12/2018 Albartus ..... E04B 1/4107
10,174,507 B1 1/2019 Henbid et al.
10,202,763 B2 * 2/2019 Hogan ..... E04C 2/46
10,233,630 B1 3/2019 Francies, III
10,240,340 B2 * 3/2019 Studer ..... E04B 1/2604
10,370,845 B2 3/2019 Francies, III
10,260,225 B2 * 4/2019 Lee ..... E04C 5/0645
10,260,230 B2 * 4/2019 Rogers ..... E04C 5/12
10,280,619 B2 * 5/2019 Moyano ..... E04B 5/04
D851,482 S 6/2019 Ferman
10,344,468 B2 * 7/2019 Yin ..... E04C 3/34
D857,480 S 8/2019 Ryan
D857,483 S 8/2019 Bevier
10,378,197 B2 * 8/2019 Kurosawa ..... E04B 1/30
10,378,199 B2 * 8/2019 Calderon Uriszar-Aldaca ..... E04B 1/388
D861,465 S 10/2019 Haider
10,480,197 B2 11/2019 Hohmann
10,538,907 B2 * 1/2020 Dooley ..... E04B 2/86
10,550,565 B2 * 2/2020 Heatly ..... E04C 2/38
10,577,789 B2 * 3/2020 Kelly ..... E04B 1/4135
10,597,863 B2 * 3/2020 Slaven, Jr. ..... E04B 1/043
10,597,865 B2 3/2020 Erlebach
10,619,342 B2 * 4/2020 Zavitz ..... E04B 1/5837
D883,774 S 5/2020 Comalander
10,640,970 B2 * 5/2020 Sarda ..... E04B 1/215
D885,868 S 6/2020 Hilmerson
D887,251 S 6/2020 Fox
10,683,656 B1 * 6/2020 Van Doren ..... E02D 27/32
D891,229 S 7/2020 Hohmann, Jr. et al.
D891,230 S 7/2020 Fox
10,731,330 B2 * 8/2020 Petricca ..... E04B 1/41
D895,403 S 9/2020 Fox
10,829,945 B2 * 11/2020 Thorp ..... E04F 13/0832
D904,170 S 12/2020 Francis
10,883,265 B2 1/2021 Kelly et al.
10,900,220 B2 * 1/2021 King ..... E04B 1/19
D920,081 S 5/2021 Peterson
11,035,115 B1 * 6/2021 Torres ..... E04B 1/4171
11,041,315 B2 * 6/2021 Hatzinikolas ..... E04F 13/0801
11,091,923 B2 8/2021 Recker et al.
11,118,345 B2 * 9/2021 Gstach ..... E04C 5/01
D939,331 S 12/2021 Comalander
11,536,020 B2 * 12/2022 Bowron ..... E04B 1/3483
11,566,416 B2 * 1/2023 Lee ..... E04B 1/6162
2002/0078657 A1 6/2002 Zambelli et al.
2003/0131543 A1 7/2003 Hansort
2004/0050012 A1 3/2004 Pulkkanen et al.
2006/0207215 A1 9/2006 Bruno
2007/0137135 A1 6/2007 Shymkowich
2007/0175174 A1 8/2007 Bruno
2009/0057518 A1 3/2009 Russell
2009/0120027 A1 * 5/2009 Amend ..... E04B 2/8611 52/565
2011/0047895 A1 3/2011 Finch
2011/0079698 A1 4/2011 Pezzimenti
2012/0137619 A1 * 6/2012 Martter ..... E04C 5/0645 52/649.1
2013/0248671 A1 9/2013 Schleiermacher et al.
2014/0250825 A1 9/2014 Richardson
2014/0260018 A1 * 9/2014 Kalloo ..... E04C 5/0645 52/745.21
2015/0191904 A1 * 7/2015 Tanaka ..... E04B 1/165 428/119
2017/0022700 A1 * 1/2017 Clark, Jr. ..... E02D 29/14
2018/0058082 A1 3/2018 Hansort
2018/0283012 A1 10/2018 Hohmann, Jr.
2018/0291620 A1 * 10/2018 Hollerbuhl ..... E04B 1/0038
2018/0298603 A1 * 10/2018 Preece ..... E04B 1/388
2019/0071862 A1 * 3/2019 White ..... F03D 13/20
2020/0141111 A1 5/2020 Kelly et al.
2021/0238843 A1 * 8/2021 Dombowsky ..... E04C 2/526
2021/0277650 A1 9/2021 Recker et al.

FOREIGN PATENT DOCUMENTS

CH 305283 2/1955
CH 684240 8/1994
DE 120510 12/1899
DE 1222634 8/1966
DE 202014006758 9/2014
EP 3081707 10/2016
GB 173031 12/1921
GB 605669 7/1948
GB 2031715 4/1980
GB 2170525 8/1986
KR 100654822 B1 * 12/2006 ..... E04B 5/32
KR 101304335 B1 * 9/2013 ..... E04B 5/18
KR 20170013455 A 2/2017

(56) References Cited

FOREIGN PATENT DOCUMENTS

| | | |
|---|---|---|
| WO | WO 2009/114902 | 9/2009 |
| WO | WO 2011/076606 | 6/2011 |

OTHER PUBLICATIONS

"Pipe Braces Brochure," SureBuilt Concrete Forms & Accessories, Mar. 26, 2019, 6 pages [retrieved online from: surebuilt-USA.com/docs/Tilt-Up-Pipe-Braces.pdf].

"Tilt-up Technical Manual," MeadowBurke, 2018, MBo418, 126 pages [retrieved online from: www.meadowburke.com/techmanuals/tilt.pdf].

Nafadi et al. "Ledge behavior and strength of long-span L-shaped beams," PCI Journal, Mar.-Apr. 2018, p. 50-66.

Facebook Rapid Lok, Date Visited: Apr. 18, 2022, Facebook, Date Available: Feb. 28, 2019, https://www.facebook.com/pg/MeadowBurke/posts/ (Year: 2019).

Official Action for U.S. Appl. No. 16/735,576, dated Apr. 1, 2022 14 pages.

Official Action for U.S. Appl. No. 29/720,068, dated Apr. 27, 2022, 10 pages.

* cited by examiner

REINFORCEMENT FOR A CONNECTOR IN A PRECAST CONCRETE PANEL

CROSS REFERENCE TO RELATED APPLICATIONS

This application claims priority under 35 U.S.C. § 119(e) to U.S. Provisional Patent Application Ser. No. 63/049,979 filed on Jul. 9, 2020 and entitled "REINFORCEMENT FOR A CONNECTOR IN A PRECAST CONCRETE PANEL," which is incorporated by reference herein in its entirety.

FIELD

The present disclosure relates to reinforcement for a connector embedded in a precast concrete panel where the connector can join the panel with another precast concrete panel, a slab, a floor joist, etc.

BACKGROUND

Precast concrete panels and associated connectors are widely used in the construction industry. Traditional concrete structures are formed in place and on site, whereas precast concrete panels are poured and cured off site in a modern manufacturing facility before being transported to the building site. Precast concrete panels allow for better quality control and reduced costs since precast forms can be reused hundreds or thousands of times. The popularity of precast concrete panels has created a demand for efficient, cost-effective connectors and methods for joining multiple precast concrete panels and floor joists, slabs, and other associated structural components.

Connectors secure precast concrete panels and floor joists together in a variety of positions and orientations. These connectors are incorporated into a precast concrete panel during construction of the panel or, alternatively, the connectors can be incorporated into a precast concrete panel after construction of the panel, for example, by bolting or otherwise securing the connector to the panel. Generally, these connectors have a two-part design where the first part is embedded in a precast concrete panel and the second part selectively interconnects to the first part to receive another precast concrete panel, a slab, a floor joist, etc. Examples of prior art devices may be found in U.S. Pat. Nos. 2,053,873 and 6,494,639, which are incorporated herein in their entireties by reference.

When the connector is positioned in the middle of a precast concrete panel and a load is imposed on the connector, the connector can distribute the load forces to a large volume of the panel. However, when the connector is positioned at an edge of the panel, which is typically the bottom edge, the load forces are distributed to a much smaller volume of the panel, and the panel is more likely to fail at this edge. For instance, when joining a floor joist to a precast concrete panel that serves as a wall, the connector is ideally at the lower end of the precast concrete panel. This configuration is an efficient use of space and of the panels and joists, but the position of the connector means that the panel is more likely to fail. This is also true for configurations where the connector is positioned at any edge of the panel such as a left edge or right edge. As a result, the connectors are rated for much smaller loads when the connectors are positioned at an edge of a panel, specifically a bottom edge.

SUMMARY

Thus, there is a need to reinforce the precast concrete panel to increase the load capacity of a connector when positioned at an edge of the panel. The above shortcomings and other needs are addressed by the various embodiments and configurations of the present disclosure. It is an objective of the present disclosure to provide reinforcement for a connector in a precast concrete panel when the connector is positioned at an end or edge of the panel. Reinforcement such as one or more hook bars embedded in the precast concrete panel in key positions and orientations distributes forces to a greater volume of the panel and increases the load capacity of the connector.

One aspect of embodiments of the present disclosure is to provide hook bars in a precast concrete panel where one hook bar extends through an anchor volume defined by the connector and one hook bar is positioned outside of the anchor volume such that the hook bars reinforce the panel directly proximate to the connector and in the volume around the connector. A receiving member is a part of the connector that is embedded in, for example, a precast concrete panel. Anchor members extend from the receiving member into the panel, and anchor members define and encompass a portion or portions of the panel that can be referred to as an anchor volume or anchor volumes. Having one hook bar extend through the anchor volume reinforces the panel immediately adjacent to the receiving member and resists tension forces caused by a load on the receiving member. The hook member positioned outside of the anchor volume helps distribute the load forces imposed on the receiving member and connector to a greater volume of the precast concrete panel to increase the load capacity of the connector.

It is a further aspect of embodiments of the present disclosure to provide a hook bar that has at least one end portion offset from a main body of the hook bar so that the hook bar encompasses a larger volume of the panel. In various embodiments, the hook bar has a main body portion, an intermediate portion extending from an end of the body portion, and an end portion extending from the intermediate portion. The intermediate portion offsets the end portion from the main body so that the hook bar encompasses a larger volume of the panel to distribute load forces to a larger volume of the panel. The end portion can be parallel to the body portion, and the hook bar can have two end portions that define an open side of the hook bar.

It is another aspect of embodiments of the present disclosure to provide a hook bar that has an open side oriented away from the receiving member so that the hook bar resists tension forces caused by a load on the receiving member and the connector. The main body portion of the hook bar can resist tension forces along a length of the body portion. Therefore, the main body portion is positioned adjacent to or proximate to the receiving member. With this orientation, the load forces imposed on the connector and receiving member are immediately transferred to the main body of the hook bar. Then, the forces are distributed to the end portions of the hook bar and the larger volume of the precast concrete panel to increase the load capacity of the connector.

In some embodiments, the hook bar is made from a single material, and the material can be, for instance, metal. In other embodiments, the hook bar is made of a composite material, for example carbon fiber or fiberglass. Metals typically resist tension forces well, but it will be appreciated that the present disclosure encompasses embodiments where the hook bar is made from other materials or made from a combination of materials that can include metal or composite materials.

In various embodiments, a method is provided for manufacturing and/or installing the hook bar or hook bars of the reinforcement system. The hook bar can be made from a metal bar that initially has a completely straight shape. The bar is bent to form the intermediate portions and end portions, and the result is a hook bar as described herein. In other embodiments, the hook bar can be formed in a mold. In other embodiments, the hook bar can be made from multiple components that are fastened together to form a hook bar with portions as described herein. Once the hook bar is made, the one or more hook bars can be installed in a form along with other components such as rebar, the receiving member, etc. Specifically, the hook bars are positioned relative to the receiving member as described herein. Then, concrete is poured into the form to completely cover and embed the one or more hook bars in the resulting precast concrete panel. It will be appreciated that the present disclosure encompasses embodiments where the hook bar is partially exposed from the precast concrete panel.

In one embodiment, a reinforcement system for a receiving member in a precast concrete panel is provided comprising: a precast concrete panel extending from a lower end to an upper end; a receiving member having a plurality of anchor members extending into the precast concrete panel, wherein at least two anchor members of the plurality of anchor members define an anchor volume therebetween, wherein a lower end of the receiving member is proximate to the lower end of the precast concrete panel; and a hook bar positioned in the precast concrete panel, the hook bar comprising: a body portion; a first intermediate portion connected on a first end to a lower end of the body portion; a first end portion connected to a second end of the first intermediate portion; and a second end portion spaced apart from the first end portion, wherein the first and second end portions are substantially parallel with the body portion, and wherein the first and second end portions form an open end that is oriented away from the receiving member.

In some embodiments, the body is offset from a back surface of the receiving member and/or the offset is between approximately 0 inch and half of a thickness of the precast concrete panel. In some embodiments, a lower end of the hook bar is offset from the from the lower end of the precast concrete panel. In various embodiments, the first intermediate portion has a curved shape and offsets the first end portion from the body portion. Additionally, the first intermediate portion has a constant radius of curvature. In some embodiments, the reinforcement system further comprises a second intermediate portion connected on a first end to an upper end of the body portion, wherein the second end portion is connected to a second end of the second intermediate portion; the second intermediate portion has a curved shape and offsets the second end portion from the body portion; and/or the second intermediate portion has a constant radius of curvature. In various embodiments, the hook bar is positioned in the precast concrete panel, the body portion of the hook bar at least partially extending through the anchor volume.

In one embodiment, a reinforcement system adapted for positioning in a precast concrete panel during manufacturing is provided comprising: a receiving member having a plurality of anchor members extending outwardly from a rear surface of the receiving member; and a hook bar comprising: a linear body portion; a first intermediate portion connected on a first end to a lower end of the body portion, wherein the first intermediate portion has a curved shape; a first end portion connected to a second end of the first intermediate portion, wherein the first intermediate portion offsets the first end portion from the body portion; and a second end portion spaced apart from the first end portion, wherein the first and second end portions are substantially parallel with the body portion.

In some embodiments, the first intermediate portion has a constant radius of curvature. In various embodiments, the reinforcement system further comprises a second intermediate portion connected on a first end to an upper end of the body portion, wherein the second end portion is connected to a second end of the second intermediate portion; the second intermediate portion has a curved shape and offsets the second end portion from the body portion; and/or the second intermediate portion has a constant radius of curvature. In some embodiments, the plurality of anchor members comprises five anchor members.

In one embodiment, a hook bar for reinforcing a precast concrete panel is provided comprising: a linear body portion; a first intermediate portion connected on a first end to a lower end of the body portion, wherein the first intermediate portion has a curved shape with a constant radius of curvature; a first end portion connected to a second end of the first intermediate portion, wherein the first intermediate portion offsets the first end portion from the body portion; a second intermediate portion connected on a first end to an upper end of the body portion; and a second end portion connected to a second end of the second intermediate portion.

In some embodiments, a height of the hook bar as measured from an uppermost point to a lowermost point is between about 60 inches and about 85 inches. In some embodiments, a width of the hook bar as measured from the body portion to the first end portion is between about 3.0 inches and about 10.0 inches. The term "about" can mean a variation of +/−10% on a relative basis. In various embodiments, the first and second end portions are substantially parallel with the body portion and are spaced apart a distance to create an open side of the hook bar.

One particular embodiment of the present disclosure is a reinforcement system for a receiving member in a precast concrete panel, comprising a precast concrete panel extending from a lower end to an upper end; a receiving member having one or more anchor members extending into the precast concrete panel, wherein a lower end of the receiving member is aligned with the lower end of the precast concrete panel; and a hook bar positioned in the precast concrete panel, the hook bar having a body portion, a first end portion, and a second end portion, wherein the first and second end portions are substantially parallel with the body portion, and the first and second end portions form an open end that is oriented away from the receiving member.

In some embodiments, the body is offset from a back surface of the receiving member. In various embodiments, the offset is between approximately 0 inch and half of a thickness of the precast concrete panel. In some embodiments, a lower end of the hook bar is offset from the from the lower end of the precast concrete panel. In various embodiments, an intermediate portion joins the first end portion to the body portion, and the intermediate portion offsets the first end portion from the body portion. In some embodiments, the body portion and the first end portion are straight, and the intermediate portion has a constant radius of curvature.

Another particular embodiment of the present disclosure is a reinforcement system for a receiving member in a precast concrete panel, comprising a precast concrete panel extending from a lower end to an upper end; a receiving member having a plurality of anchor members extending into the precast concrete panel, wherein at least two anchor members of the plurality of anchor members define an anchor volume therebetween, and a lower end of the receiving member is aligned with the lower end of the precast concrete panel; a first hook bar positioned in the precast concrete panel, the first hook bar having a body portion at least partially extending through the anchor volume; and a second hook bar positioned in the precast concrete panel and positioned outside of the anchor volume.

In various embodiments, the first hook bar further comprises a first end portion and a second end portion that are substantially parallel with the body portion, and the first and second end portions form an open end that is oriented away from the receiving member. In some embodiments, the body is positioned against a back surface of the receiving member. In various embodiments, the plurality of anchor members is five anchor members.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings. Additional aspects of the present disclosure can be found in the Appendix, which is incorporated herein in its entirety by reference.

The above-described embodiments, objectives, and configurations are neither complete nor exhaustive. As will be appreciated, other embodiments of the disclosure are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and claims themselves.

Any one or more aspects described herein can be combined with any other one or more aspects described herein. Any one or more features described herein can be combined with any other one or more features described herein. Any one or more embodiments described herein can be combined with any other one or more embodiments described herein.

BRIEF DESCRIPTION OF THE DRAWINGS

The accompanying drawings, which are incorporated in and constitute a part of the specification, illustrate embodiments of the disclosure and together with the Summary given above and the Detailed Description of the drawings given below, serve to explain the principles of these embodiments. In certain instances, details that are not necessary for an understanding of the disclosure or that render other details difficult to perceive may have been omitted. It should be understood, of course, that the disclosure is not necessarily limited to the particular embodiments illustrated herein. Additionally, it should be understood that the drawings are not necessarily to scale.

Figure 1:
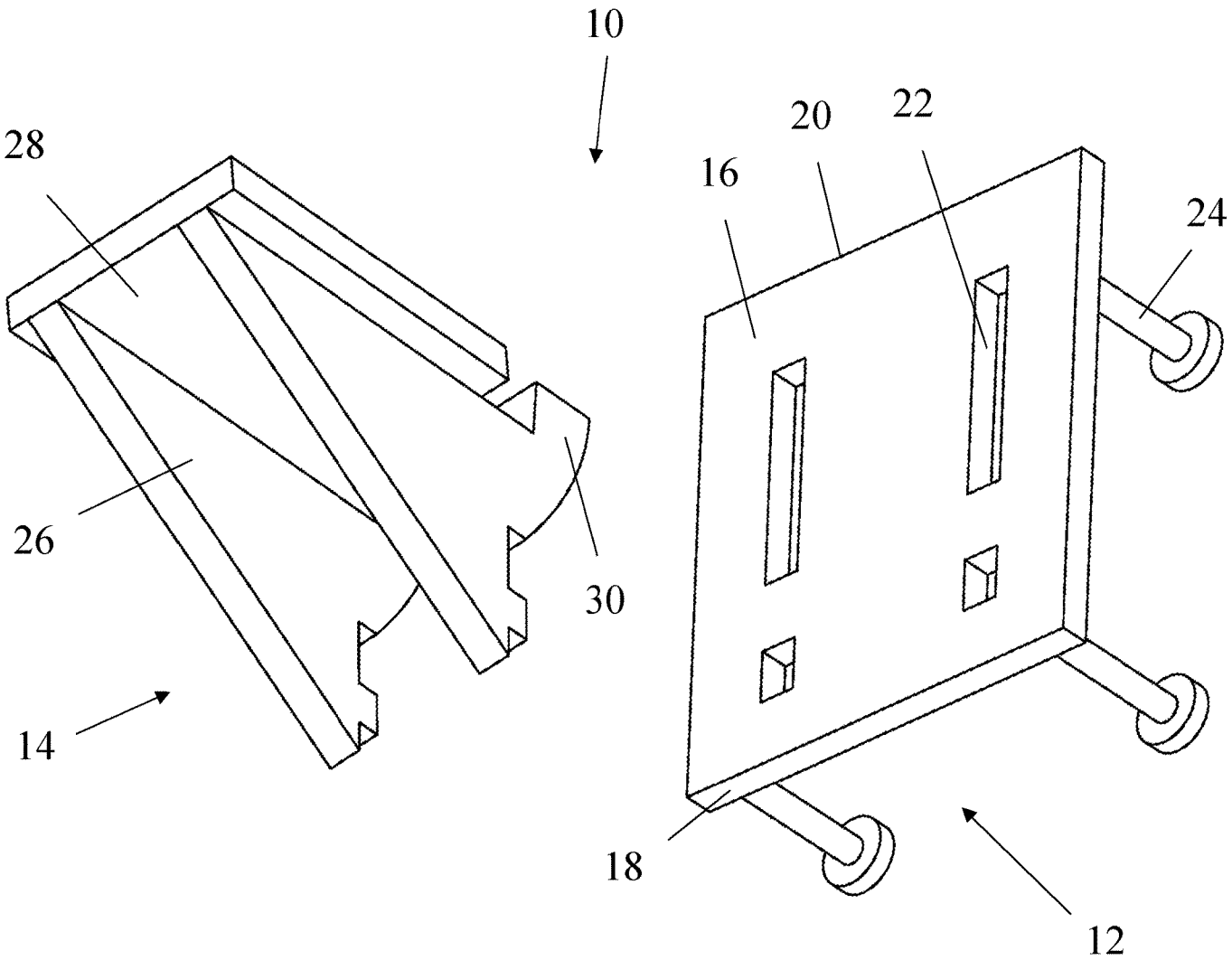
FIG. 1 Prior Art
FIG. 1 is a front perspective view of a prior art connector with an attachment member and a receiving member.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Connector |
| 12 | Receiving Member |
| 14 | Attachment Member |
| 16 | Body of Receiving Member |
| 18 | Lower End of Body of Receiving Member |
| 20 | Upper End of Body of Receiving Member |
| 22 | Aperture |
| 24 | Anchor Member of Receiving Member |
| 26 | Vertical Member of Attachment Member |
| 28 | Horizontal Member of Attachment Member |
| 30 | Protrusion |

-continued

| Number | Component |
|---|---|
| 32 | Precast Concrete Panel |
| 34 | Void |
| 36 | Floor Joist |
| 38 | Reinforcement System |
| 40 | Hook Bar |
| 42 | Lower End of Hook Bar |
| 44 | Lower End of Concrete Panel |
| 46 | Vertical Offset |
| 48 | Horizontal Offset |
| 50 | Anchor Volume |
| 52 | Body Portion |
| 54 | Intermediate Portion |
| 56 | Width |
| 58 | First End Portion |
| 60 | Second End Portion |
| 62 | Open Side |
| 64 | Gap or Distance between End Portions |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present disclosure are described herein and as depicted in the drawings. It is expressly understood that although the figures depict precast concrete panels, connectors, hook bars, and methods and systems for using the same, the present disclosure is not limited to these embodiments. Moreover, it will be appreciated that while the present disclosure is described in terms of a "precast concrete panel", the present disclosure encompasses any concrete structure or structure in which a connector can be embedded and used to join the structure to another structure.

Now referring to FIG. 1, a perspective view of a prior art connector 10 is provided. Generally, the connector 10 comprises an attachment member 14 that selectively interconnects to a receiving member 12. A body 16 of the receiving member 12 extends from a lower end 18 to an upper end 20, and the receiving member 12 can be embedded in a precast concrete panel such that the body 16 is substantially parallel to a side wall or surface of the precast concrete panel. One or more apertures 22 extend through the body 16, and at least one anchor member 24 extends from the body 16 and into the precast concrete panel to secure and embed the receiving member 12 in the precast panel. Any number of anchor members 24 can extend from the body 16 in any number of configurations.

The attachment member 14 has several features that allow the attachment member 14 to rapidly and securely interconnect to the receiving member 12 and bear a second precast concrete panel, a slab, a floor joist, etc. The attachment member 14 in FIG. 1 has a horizontal member 28 on which a second precast concrete panel can rest, and two vertical members 26 extend downward from the horizontal member 28 in a substantially parallel manner. The vertical members 26 taper from a proximal end to a distal end of the horizontal member 28 and the attachment member 14. The proximal end of the attachment member 14 also has one or more protrusions 30 that are designed and shaped to fit and extend into the apertures 22 of the receiving member 12. The apertures 22 and the protrusions 30 may have a corresponding variety of positions, numbers, shapes, etc.

Figure 2:
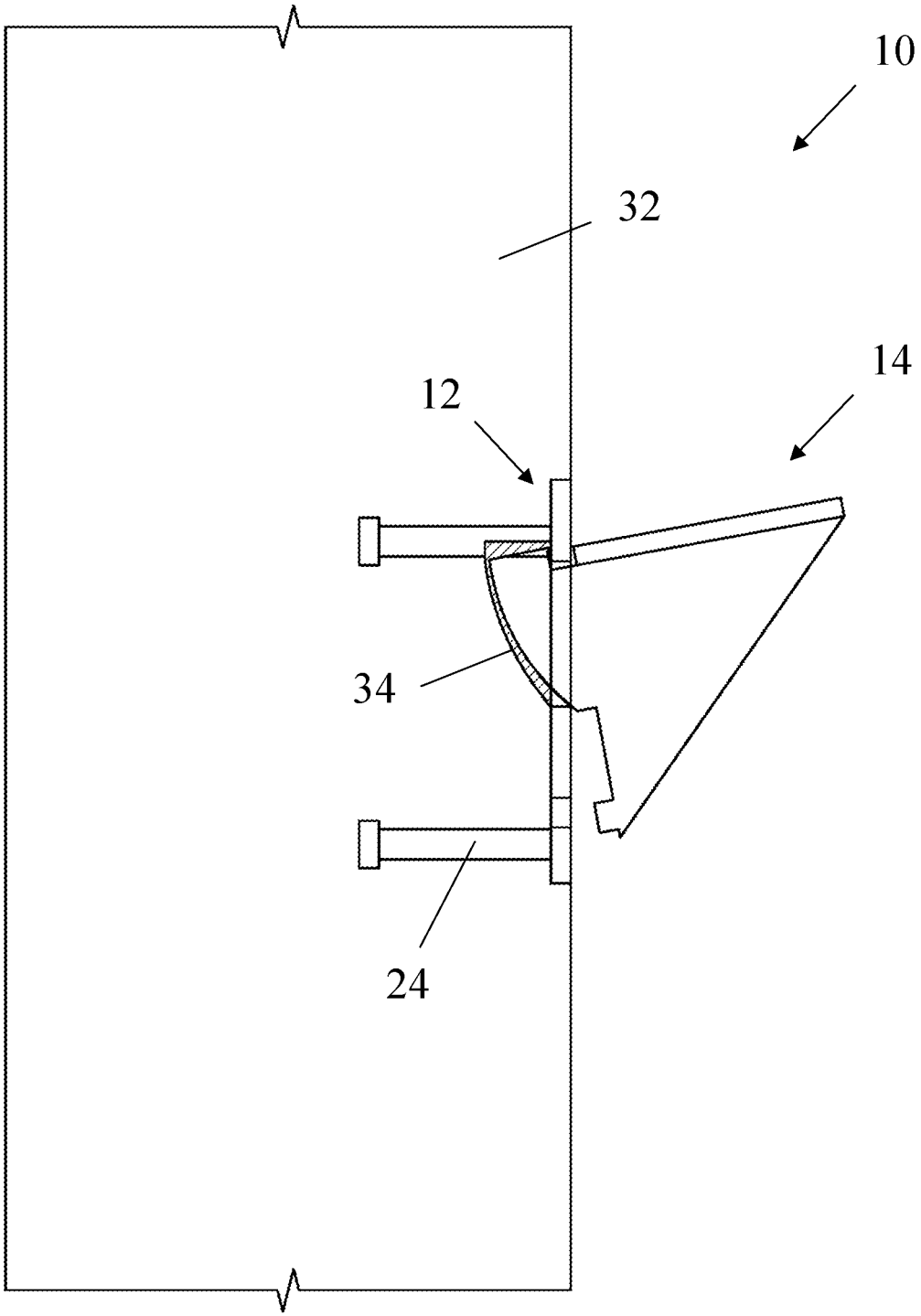
FIG. 2 Prior Art
FIG. 2 is a partial cross-sectional, side elevation view of the prior art connector in FIG. 1 with an attachment member in a first position.
Figure 3:
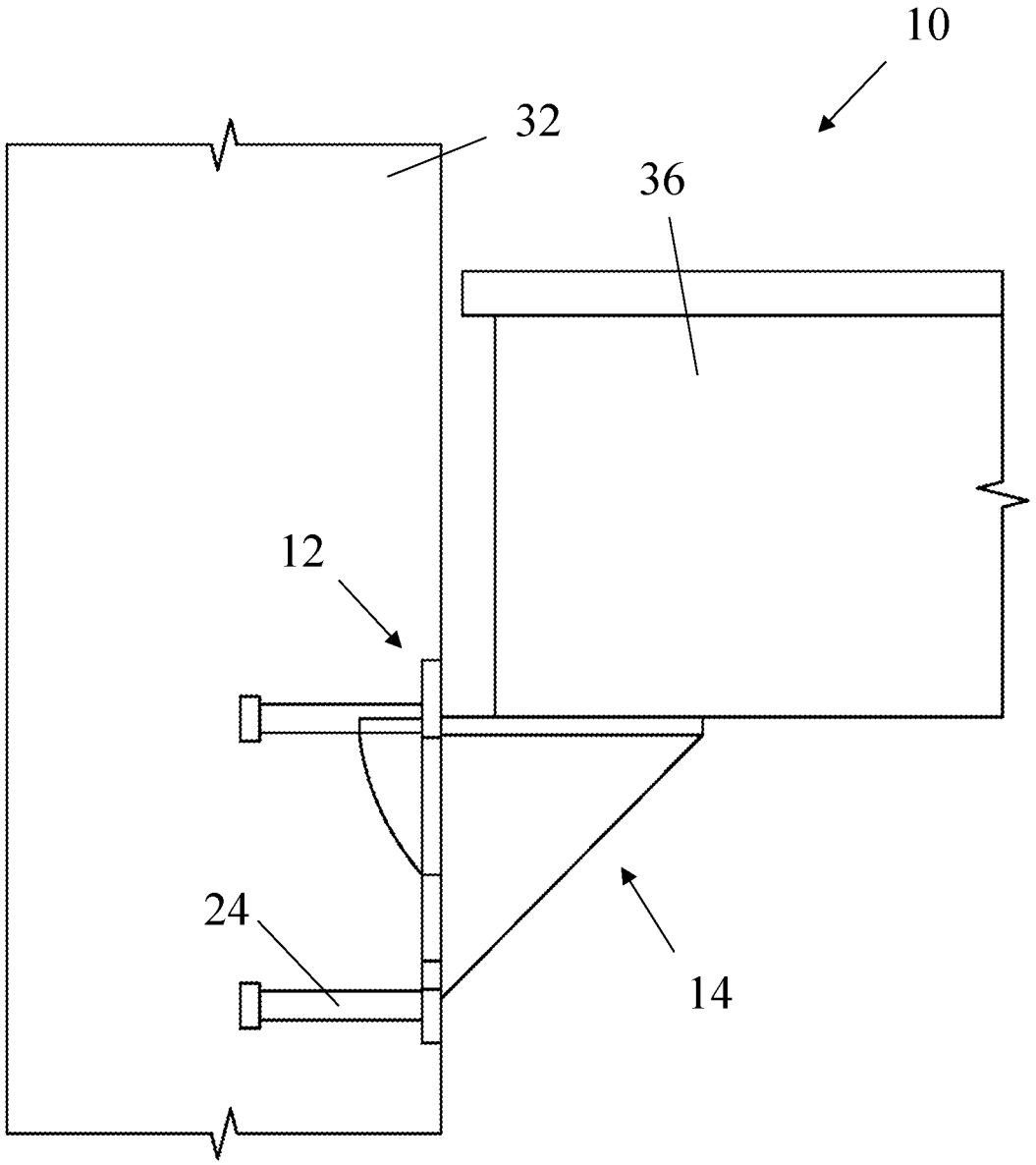
FIG. 3 Prior Art
FIG. 3 is a partial cross-sectional, side elevation view of the prior art connector in FIG. 1 with an attachment member in a second position and a floor joist positioned on the attachment member.

Now referring to FIGS. 2 and 3, partial cross-sectional views of the prior art connector 10 are provided. The attachment member 14 is in a first position in FIG. 2 and engages the receiving member 12 at an acute angle. Then, the attachment member 14 is in a second position in FIG. 3 where the attachment member 14 has rotated into a volume 34 defined by a void former, and the attachment member 14 is selectively interconnected to the receiving member 12. Once in the second position, the attachment member 14 can bear a floor joist 36 or other object and transmit forces to the receiving member 12 and precast concrete panel 32. Further description of a connector 10 can be found in U.S. Publication No. 2018/0347179, which is incorporated herein in its entirety by reference.

Figure 4:
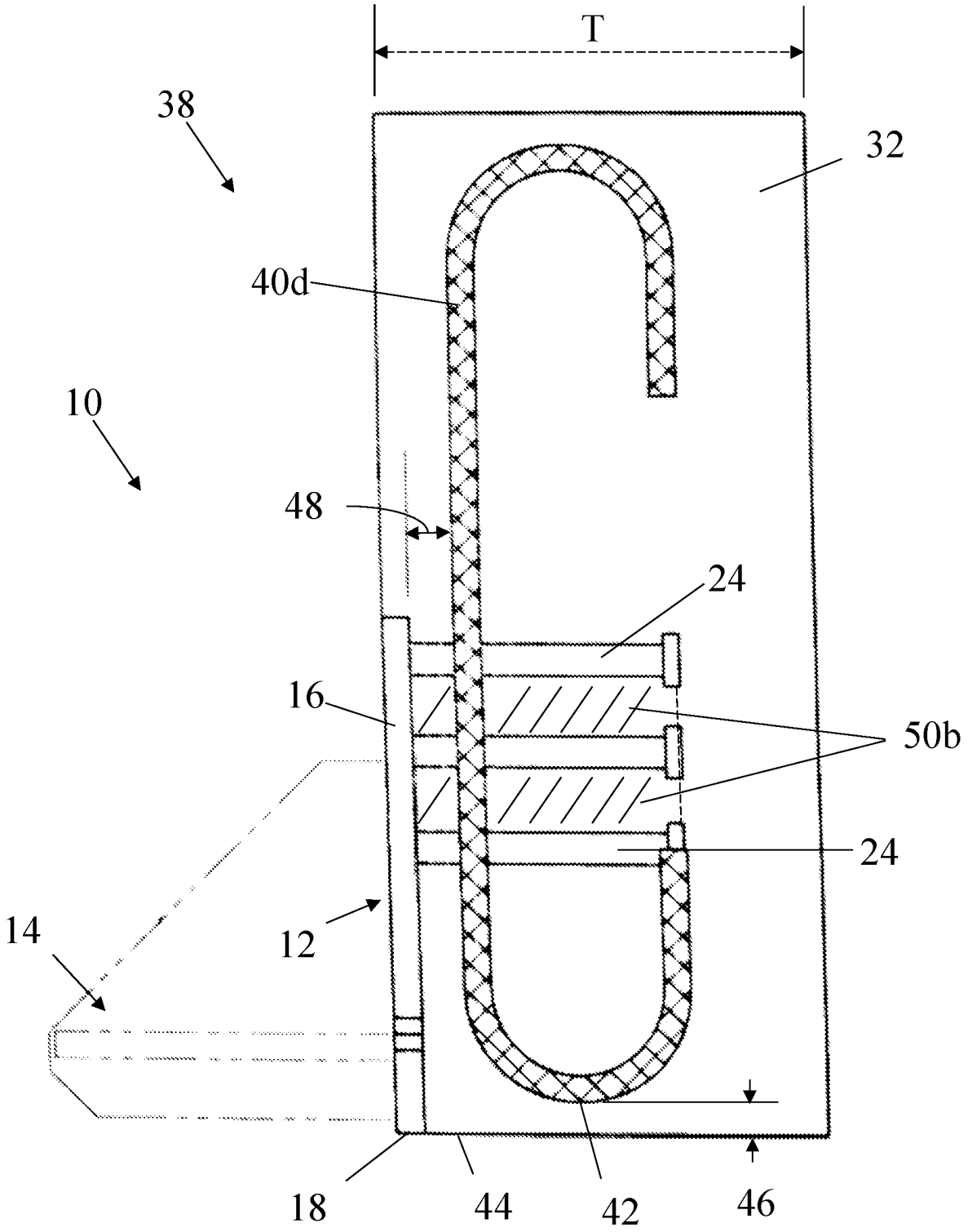
FIG. 4 is a partial cross-sectional, side elevation view of a reinforcement system with a hook bar according to one embodiment of the present disclosure.

Now referring to FIG. 4, a partial cross-sectional, side elevation view of a reinforcement system 38 with a hook bar **40*d* is provided. As shown, the hook bar 40*d* is embedded in the precast concrete panel 32, and anchor members 24 extend from the receiving member 12 into the precast concrete panel 32. The lower end 18 of the receiving member 12 is flush or aligned with the lower end 44 of the precast concrete panel 32 as described herein. An attachment member 14 is selectively connected to the receiving member 12, and the attachment member 14** can receive another object such as a floor joist.

The hook bar **40*d* is embedded in the precast concrete panel 32 to increase the strength of the precast concrete panel 32 and the load capacity of the receiving member 12 and connector. The hook bar 40*d* is positioned proximate to the receiving member 12, and a lower end 42 of the hook bar 40*d* is offset from the lower end 44 of the precast concrete panel 32 a vertical offset 46 such that the hook bar 40*d* is completely embedded in the precast concrete panel 32. In addition, the hook bar 40*d* is horizontally offset 48 from a back surface of the receiving member 12. This horizontal offset 48 can be 0 inches such that the hook bar 40*d* contacts the back surface of the receiving member 12. In some embodiments, the horizontal offset 48 is between approximately 0 inches and half of a thickness T of the precast concrete panel. The term "approximately" can mean a variation of +/−10% on a relative basis. Also shown in FIG. 4 is an anchor volume 50***b* defined by the anchor members 24 and the dashed lines.

Generally, the connector 10 comprises an attachment member 14 that selectively interconnects to a receiving member 12. A body 16 of the receiving member 12 extends from a lower end 18 to an upper end 20, and the receiving member 12 can be embedded in a precast concrete panel 32 such that the body 16 is substantially parallel to a side wall or surface of the precast concrete panel 32. One or more apertures can extend through the body 16, and at least one anchor member 24 extends from the body and into the precast concrete panel 32 to secure and embed the receiving member 12 in the precast concrete panel 32. The attachment member 14 can be similar to the attachment member 14 described in FIGS. 1-3 in some embodiments, while have a different configuration in other embodiments.

It will be appreciated that the present disclosure may include any number of anchor members 24 extending from the body 16 in any number of configurations. Moreover, the anchor members 24 can have different shapes and sizes than those shown in FIG. 4. It will be appreciated that the protrusions 30 may have a variety of positions, numbers, shapes, etc.

Figure 5:
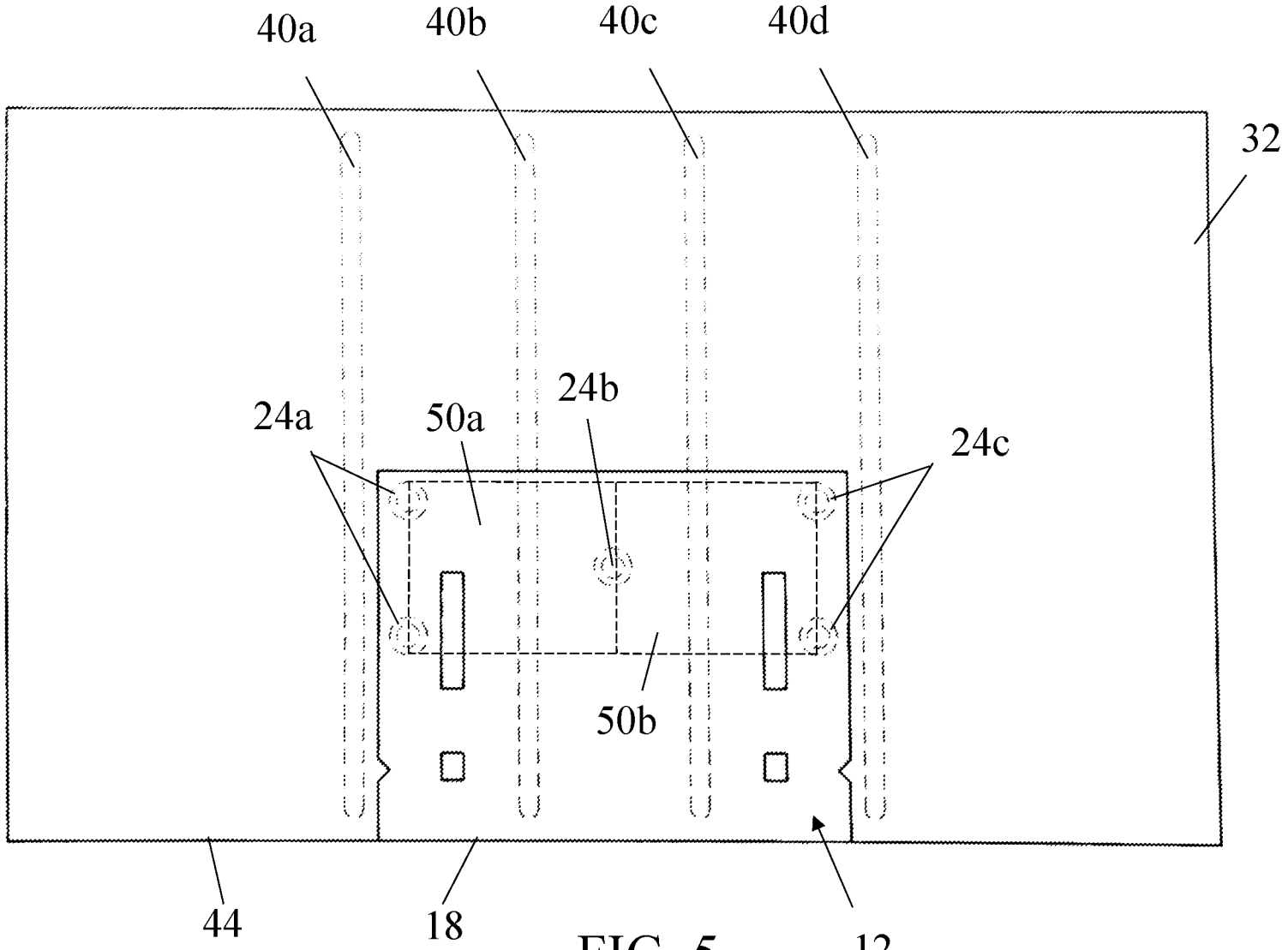
FIG. 5 is a front elevation view of the reinforcement system of FIG. 4.

Now referring to FIG. 5, a front elevation view of a reinforcement system 38 with hook bars 40*a*-40*d* is provided. Multiple hook bars 40*a*-40*d* are arranged across a width of the precast concrete panel 32 to strengthen the volume of the precast concrete panel 32 proximate to the receiving member 12 and to distribute load forces to a greater volume of the precast concrete panel 32. Also shown in FIG. 5 is a plurality of anchor members with two left anchor members 24*a*, one center anchor member 24*b*, and two right anchor members 24*c*. The two left anchor members 24*a* are aligned in the vertical direction, and the two right anchor members 24*c* are also aligned in the vertical direction. Additionally, the upper left anchor member 24*a* is aligned in the horizontal direction with the upper right anchor member 24*c*. And the lower left anchor member 24*a* is aligned in the horizontal direction with the lower right anchor member 24*c*. However, the anchor members 24*a*, 24*c* do not have to aligned in the vertical or horizontal direction.

A first anchor volume 50*a* is defined between the two left anchor members 24*a* and the center anchor member 24*b*. Similarly, a second anchor volume 50*b* is defined between the center anchor member 24*b* and the two right anchor members 24*c*. The upper bounds of the anchor volumes 50*a*, 50*b* can be defined by the upper left anchor member 24*a* and the upper right anchor member 24*c*, respectively. The lower bounds of the anchor volumes 50*a*, 50*b* can be defined by the lower left anchor member 24*a* and the lower right anchor member 24*c*, respectively. The anchor volumes 50*a*, 50*b* extend from the back surface of the receiving member 12 to the distal end of the anchor members as best shown in FIG. 4

Hook bars 40*a*-40*d* extend within and outside of these anchor volumes 50*a*, 50*b* to reinforce the precast concrete panel 32. A first hook bar 40*a* is positioned completely outside of the first and second anchor volumes 50*a*, 50*b*. More specifically, in various embodiments, the first hook bar 40*a* can be described as positioned to the left of the left side of the receiving member 12 and to the left of the two left anchor members 24*a*. Next, at least a portion of a second hook bar 40*b* extends through one anchor volume 50*a*, and at least a portion of a third hook bar 40*c* extends through another anchor volume 50*b*. Lastly, a fourth hook bar 40*d* is positioned completely outside of the first and second anchor volumes 50*a*, 50*b*. More specifically, in various embodiments, the fourth hook bar 40*d* can be described as positioned to the right of the right side of the receiving member 12 and to the right of the two right anchor members 24*c*.

Moreover, in the depicted embodiment, the hook bars 40*a*-40*d* are oriented parallel to each other and perpendicular to the lower ends of the receiving member 12 and precast concrete panel 32. In other words, the hook bars 40*a*-40*d* extend away from the portion of the panel 32 where forces are concentrated when a load is imposed on the receiving member 12 and connector. Therefore, the hook bars 40*a*-40*d* distribute the forces away from the receiving member 12 and to a greater volume of the panel 32. The result is an increase in the load capacity of the receiving member 12 and connector. However, it will be appreciated that in other embodiments, the hook bars 40*a*-40*d* are not parallel with each other and/or the hook bars 40*a*-40*d* are not perpendicular to the lower end 44 or any other end or edge of the precast concrete panel 32. In some embodiments, the hook bars 40*a*-40*d* are not evenly spaced apart. Moreover, any number of hook bar 40 could be used, for example 2, 3, 4, 5, 6, 7, or 8 or more.

In some embodiments, the relationship between the receiving member 12 and the hook bars 40 can be described as at least a portion of one hook bar extends through an anchor volume 50, and at least one other hook bar 40 is positioned outside of the anchor volume 50. Thus, the hook bars 40 reinforce both the immediate volume behind the receiving member 12 and the volume adjacent to the receiving member 12 to distribute load forces to a greater volume of the precast concrete panel 32.

While five anchor members 24 are depicted in the figures, any number of anchor members 24 is contemplated, for example, 3, 4, 5, 6, 7, or 8 or more anchor members 24. Moreover, an anchor volume 50 can be defined by two anchor members 24 where the upper and lower bounds of the anchor volume 50 can be defined by the upper and lower sides of the two anchor members 24, respectively. Similarly, while four hook bars 40*a*-40*d* are depicted in the drawings, various embodiments of the present disclosure can have any number of hook bars 40.

Figure 6:
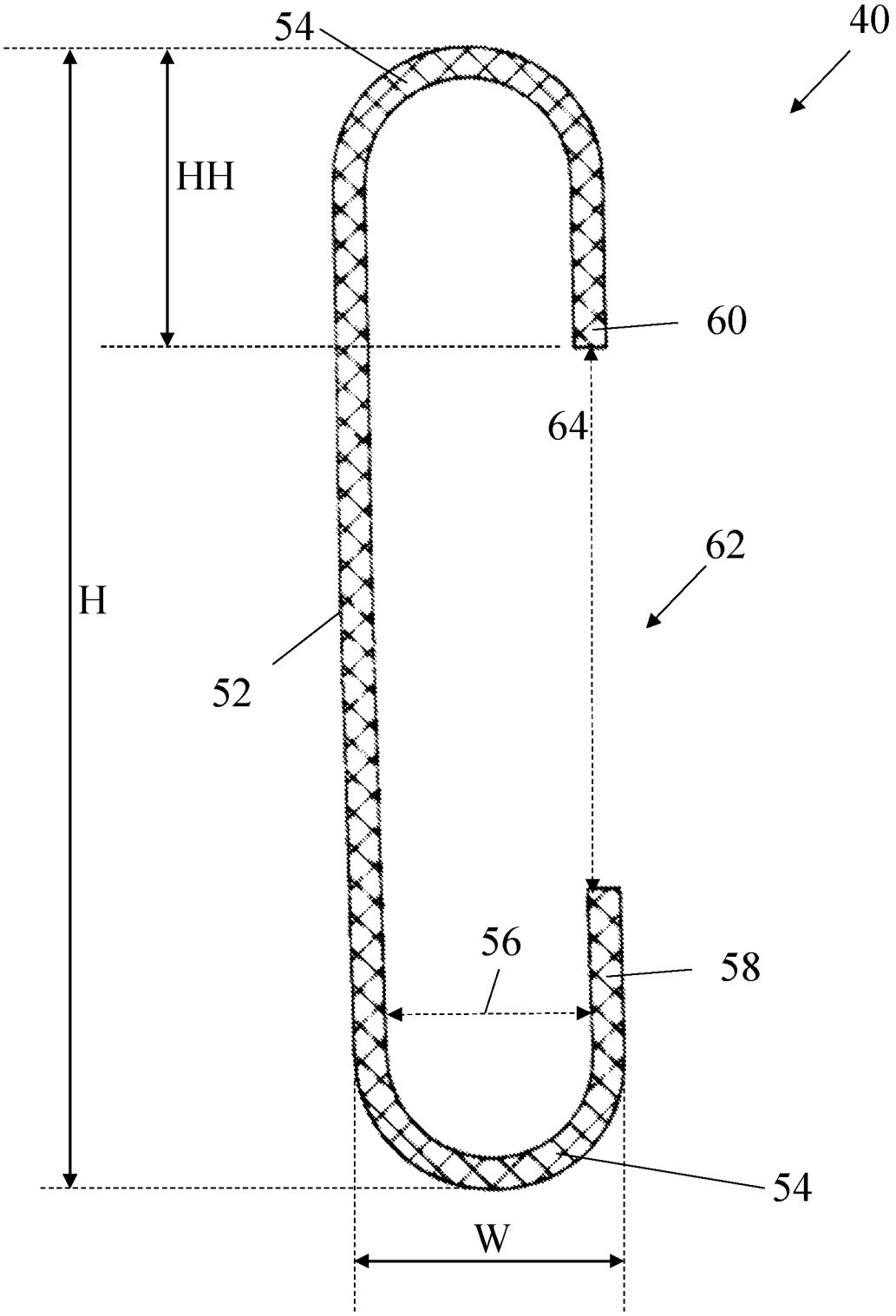
FIG. 6 is a side elevation view of the hook bar of FIG. 4 according to one embodiment of the present disclosure.

Now referring to FIG. 6, a side elevation view of a hook bar 40 is provided. This hook bar 40 has a straight body portion 52, and each end of the body portion 52 transitions into an intermediate portion 54. In the embodiment shown, the intermediate portion 54 is curved with a radius of curvature. Next, each intermediate portion 54 transitions into an end portion, such that the hook bar 40 has a first end portion 58 and a second end portion 60. The end portions 58, 60 in this embodiment are straight, substantially parallel with the body portion 52, and offset from the body portion 52 a hook width 56. The term "substantially" in this context can be a variation of +/−10% on a relative basis, which in this case is the variation of an angle in terms of degrees. The end portions 58, 60 are separated a distance 64 and define an open side 62 of the hook bar 40 as opposed to the closed side of the body portion 52.

This arrangement and orientation of portions provide several advantages. The end portions 58, 60 are offset from the body portion 52 a width 56 to allow the hook bar 40 to encompass a greater portion of the precast concrete panel. In addition, the body portion 52 is positioned next to the receiving member and takes up tension forces caused by a load on the connector. Thus, referring back to FIG. 4, the open side 62 of the hook bar 40 is oriented away from the receiving member, and the body portion 52 is positioned closely to or proximate to the receiving member. As a result, the hook bar 40 transfers forces from the receiving member to a greater volume of the precast concrete panel.

While the intermediate portion 54 is shown as having a constant radius of curvature and the end portions 58, 60 are straight and parallel with the body portion 52, it will be appreciated that embodiments of the present disclosure encompass many variations of these components of the hook bar 40. For example, embodiments can include an intermediate portion 54 that extends horizontally for a predetermined distance, a non-straight end portion that is not necessarily parallel with the body portion 52, a hook bar 40 with only one end portion 58, 60, etc. In some embodiments, the end portion or portions can be described as at least partially curving or returning back so that the end portion or portions overlap the body portion of the hook bar when viewing the hook bar in a front or review elevation view.

The hook bar 40 can have various dimensions, including a width W, height H, and hook height HH. In some embodiments, the height H of the hook bar 40 is between about 60 inches and about 85 inches, or in some embodiments about 60 inches, 65 inches, 66 ⅜ inches, 70 inches, 75 inches, 80 inches, 82 inches, and 85 inches, or a range or value between two of these values. The term "about" can mean a variation of +/−10% on a relative basis. In a first preferred embodiment, the height H of the hook bar 40 is about 66 ⅜ inches. In a second preferred embodiment, the height H of the hook bar 40 is about 82 inches. In some embodiments, the hook height HH is between about 4.0 inches and about 8.0 inches, or in some embodiments 4.0 inches, 5.0 inches, 6.0 inches, 7.0 inches, and 8.0 inches, or a range or value between two of these values. In a preferred embodiment, the hook height HH is about 6.0 inches. In some embodiments, the width W of the hook bar 40 is between about 3.0 inches and about 10.0 inches, or in some embodiments 3.0 inches, 4.0 inches, 5.0 inches, 6.0 inches, 7.0 inches, 8.0 inches, 9.0 inches, and 10.0 inches, or a range or value between two of these values. In a preferred embodiment, the width W of the hook bar 40 is about 5.0 inches.

Figure 7:
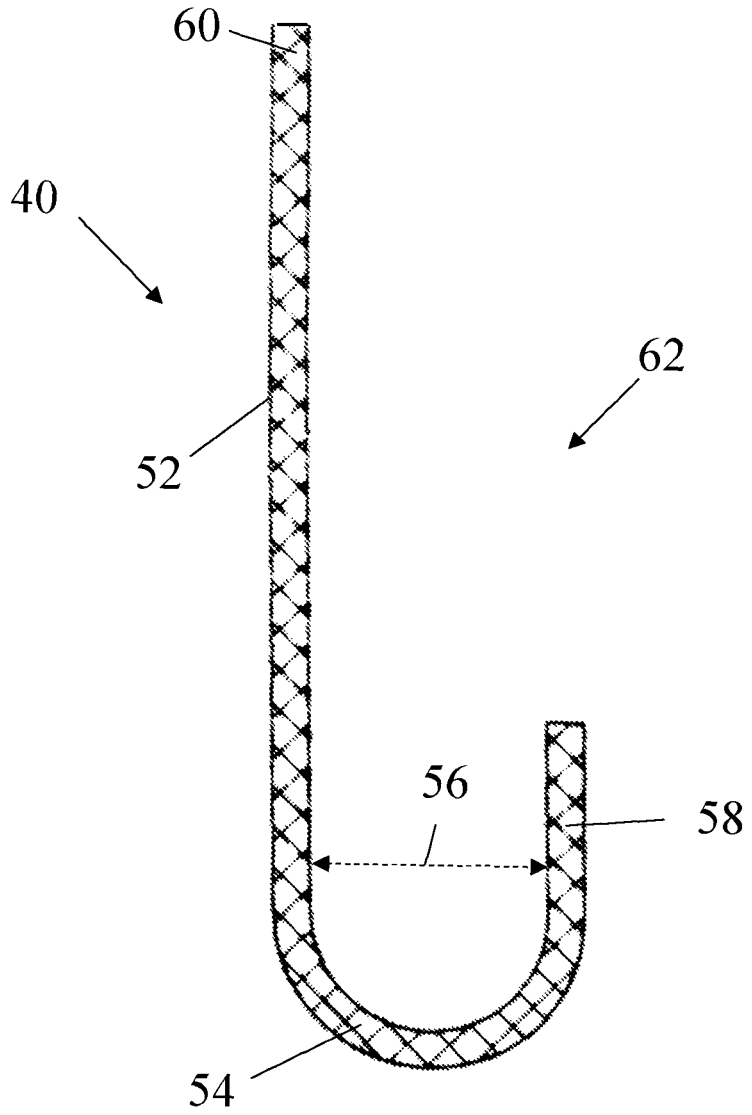
FIG. 7 is a side elevation view of a hook bar according to another embodiment of the present disclosure.

Now referring to FIG. 7, a side elevation view of another embodiment of a hook bar 40 is provided. This hook bar 40 has a straight body portion 52 and one end of the body portion 52 transitions into an intermediate portion 54. In the embodiment shown, the intermediate portion 54 is curved with a radius of curvature. Next, the intermediate portion 54 transitions into a first portion 58. The first end portion 58 in this embodiment is straight, substantially parallel with the body portion 52, and offset from the body portion 52 a hook width 56. The term "substantially" in this context can be a variation of +/−10% on a relative basis, which in this case is the variation of an angle in terms of degrees. The hook bar 40 has an open side 62 as opposed to the closed side of the body portion 52. The body portion 52 terminates on an upper end at a second end portion 60. In some embodiments, the intermediate portion 54, i.e., the hook shape, could be positioned at the upper end and the body portion 52 could terminate on the lower end at a straight second end portion 60.

The first end portion 58 is offset from the body portion 52 a width 56 to allow the hook bar 40 to encompass a greater portion of the precast concrete panel. In addition, the body portion 52 is positioned next to the receiving member and takes up tension forces caused by a load on the connector. Thus, referring back to FIG. 4, the open side 62 of the hook bar 40 is oriented away from the receiving member, and the body portion 52 is positioned closely to or proximate to the receiving member. As a result, the hook bar 40 transfers forces from the receiving member to a greater volume of the precast concrete panel.

In some embodiments, the first end portion 58 can at least partially curve or return back so that the first end portion 58 overlaps the body portion 52 of the hook bar when viewing the hook bar 40 in a front or review elevation view.

Figure 8:
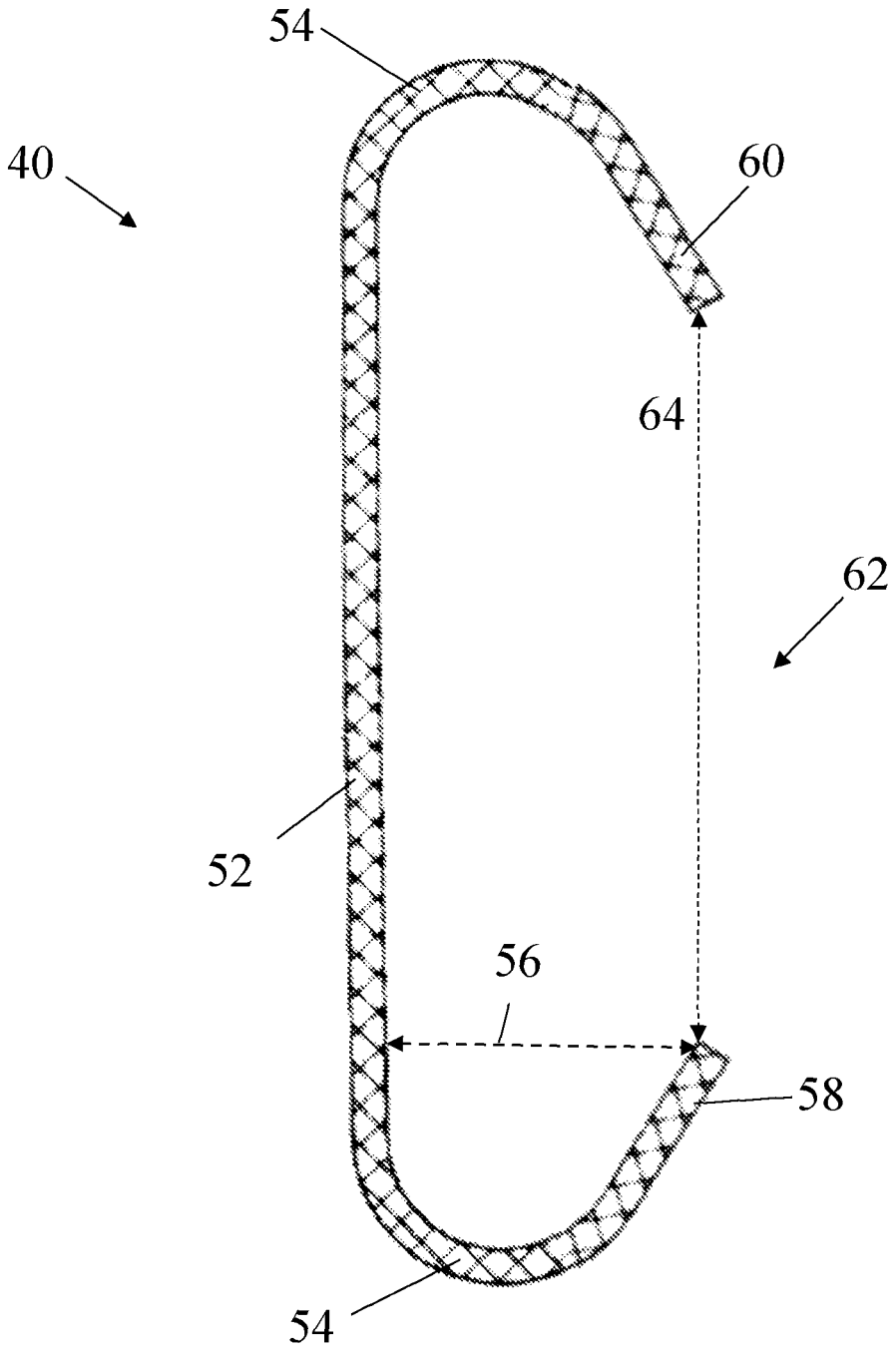
FIG. 8 is a side elevation view of a hook bar according to another embodiment of the present disclosure.

Now referring to FIG. 8, a side elevation view of another embodiment of a hook bar 40 is provided. This hook bar 40 has a straight body portion 52, and each end of the body portion 52 transitions into an intermediate portion 54. In the embodiment shown, the intermediate portion 54 is curved with a radius of curvature. Next, each intermediate portion 54 transitions into an end portion, such that the hook bar 40 has a first end portion 58 and a second end portion 60. The end portions 58, 60 in this embodiment are straight and angled away from the body portion 52. The end portions 58, 60 are offset from the body portion 52 a width 56. The end portions 58, 60 are separated a distance 64 and define an open side 62 of the hook bar 40 as opposed to the closed side of the body portion 52.

The end portions 58, 60 are offset from the body portion 52 a width 56 to allow the hook bar 40 to encompass a greater portion of the precast concrete panel. In addition, the body portion 52 is positioned next to the receiving member and takes up tension forces caused by a load on the connector. Thus, referring back to FIG. 4, the open side 62 of the hook bar 40 is oriented away from the receiving member, and the body portion 52 is positioned closely to or proximate to the receiving member. As a result, the hook bar 40 transfers forces from the receiving member to a greater volume of the precast concrete panel.

While the intermediate portion 54 is shown as having a constant radius of curvature and the end portions 58, 60 are straight and angled away from with the body portion 52, it will be appreciated that embodiments of the present disclosure encompass many variations of these components of the hook bar 40. For example, embodiments can include an intermediate portion 54 that extends horizontally for a predetermined distance, a non-straight end portion that is not necessarily parallel with the body portion 52, a hook bar 40 with only one end portion 58, 60, etc.

Figure 9:
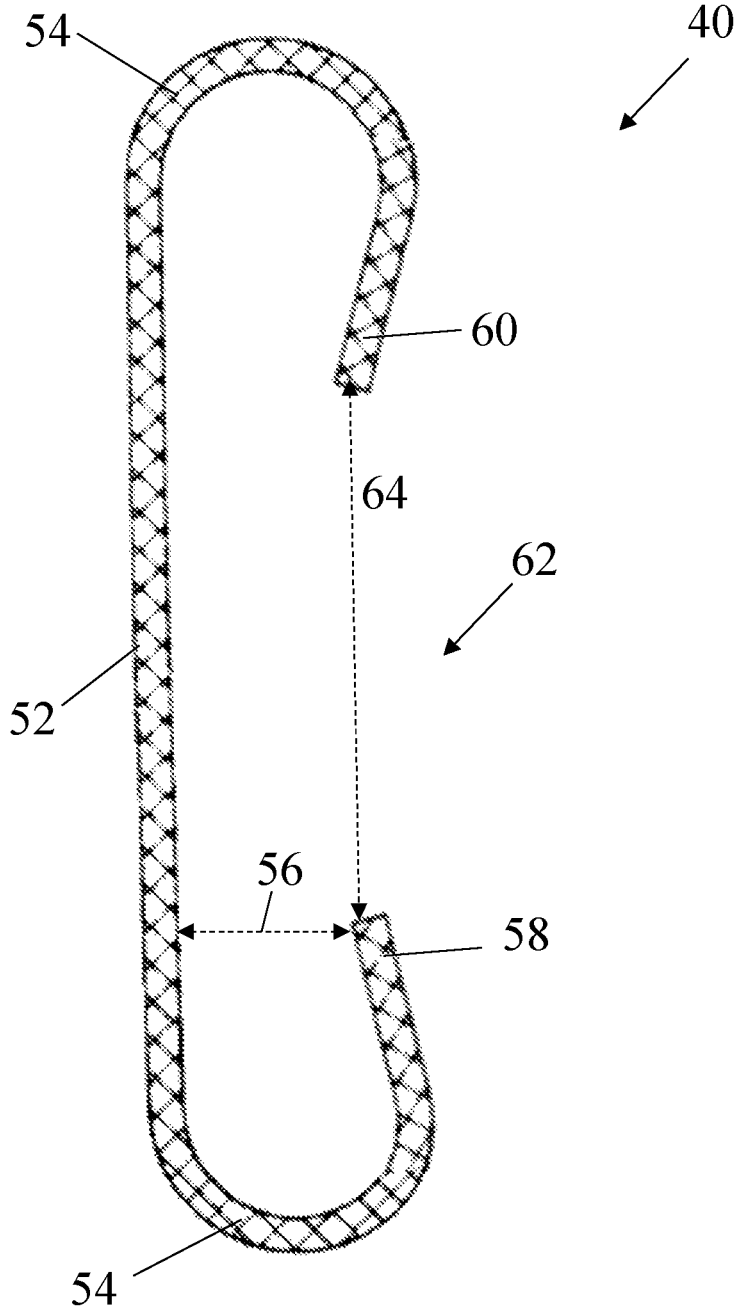
FIG. 9 is a side elevation view of a hook bar according to another embodiment of the present disclosure.

Now referring to FIG. 9, a side elevation view of another embodiment of a hook bar 40 is provided. This hook bar 40 has a straight body portion 52, and each end of the body portion 52 transitions into an intermediate portion 54. In the embodiment shown, the intermediate portion 54 is curved with a radius of curvature. Next, each intermediate portion 54 transitions into an end portion, such that the hook bar 40 has a first end portion 58 and a second end portion 60. The end portions 58, 60 in this embodiment are straight and angled inwardly toward the body portion 52, and offset from the body portion 52 a width 56. The end portions 58, 60 are separated a distance 64 and define an open side 62 of the hook bar 40 as opposed to the closed side of the body portion 52.

This arrangement and orientation of portions provide several advantages. The end portions 58, 60 are offset from the body portion 52 a width 56 to allow the hook bar 40 to encompass a greater portion of the precast concrete panel. In addition, the body portion 52 is positioned next to the receiving member and takes up tension forces caused by a load on the connector. Thus, referring back to FIG. 4, the open side 62 of the hook bar 40 is oriented away from the receiving member, and the body portion 52 is positioned closely to or proximate to the receiving member. As a result, the hook bar 40 transfers forces from the receiving member to a greater volume of the precast concrete panel.

While the intermediate portion 54 is shown as having a constant radius of curvature and the end portions 58, 60 are straight, it will be appreciated that embodiments of the present disclosure encompass many variations of these components of the hook bar 40. For example, embodiments can include an intermediate portion 54 that extends horizontally for a predetermined distance, a non-straight end portion that is not necessarily parallel with the body portion 52, a hook bar 40 with only one end portion 58, 60, etc. In some embodiments, the end portion or portions can be described as at least partially curving or returning back so that the end portion or portions overlap the body portion of the hook bar when viewing the hook bar in a front or review elevation view.

Figure 10:
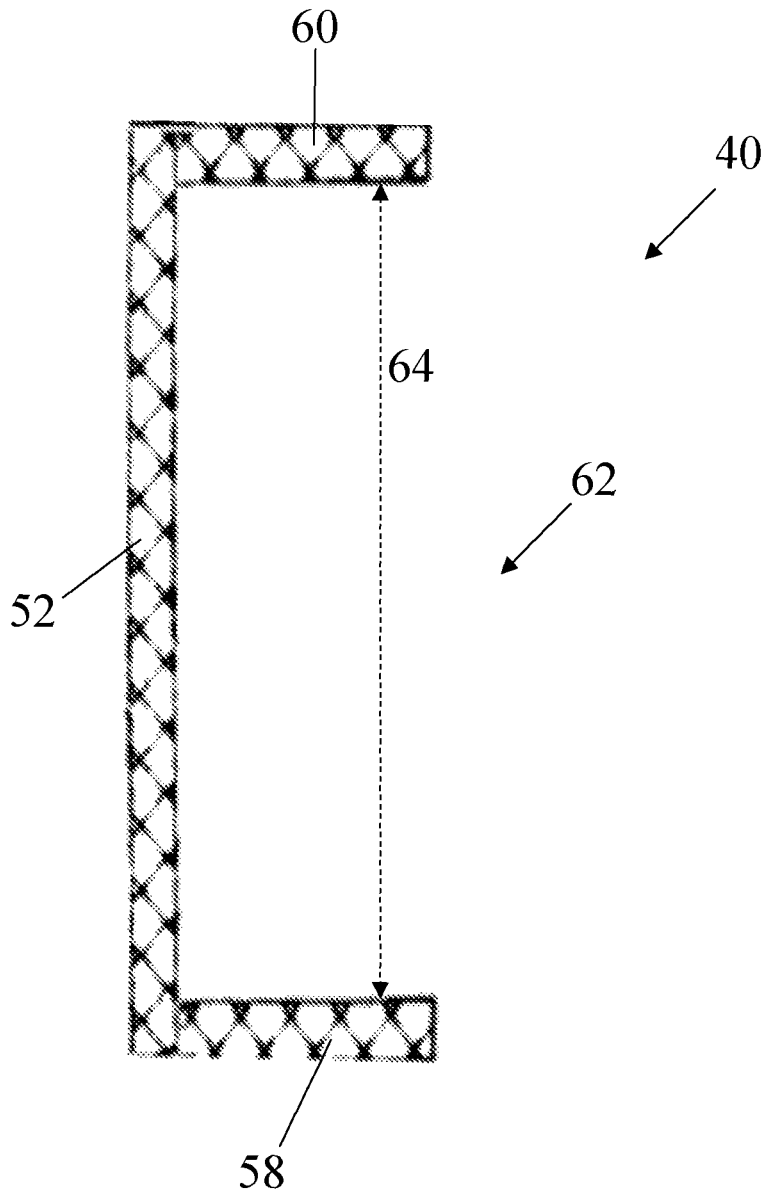
FIG. 10 is a side elevation view of a hook bar according to another embodiment of the present disclosure.

Now referring to FIG. 10, a side elevation view of another embodiment of a hook bar 40 is provided. This hook bar 40 has a straight body portion 52, and each end of the body portion 52 is interconnected to an end portion, such that the hook bar 40 has a first end portion 58 and a second end portion 60. The end portions 58, 60 in this embodiment are straight and substantially perpendicular to the body portion 52. The term "substantially" in this context can be a variation of +/−10% on a relative basis, which in this case is the variation of an angle in terms of degrees. The end portions 58, 60 are separated a distance 64 and define an open side 62 of the hook bar 40 as opposed to the closed side of the body portion 52.

The end portions 58, 60 extend away from the body portion 52 to allow the hook bar 40 to encompass a greater portion of the precast concrete panel. In addition, the body portion 52 is positioned next to the receiving member and takes up tension forces caused by a load on the connector. Thus, referring back to FIG. 4, the open side 62 of the hook bar 40 is oriented away from the receiving member, and the body portion 52 is positioned closely to or proximate to the receiving member. As a result, the hook bar 40 transfers forces from the receiving member to a greater volume of the precast concrete panel.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

Any one or more aspects described herein can be combined with any other one or more aspects described herein. Any one or more features described herein can be combined with any other one or more features described herein. Any one or more embodiments described herein can be combined with any other one or more embodiments described herein.

What is claimed is:

1. A reinforcement system for a receiving member in a precast concrete panel, comprising:

a precast concrete panel extending from a lower end to an upper end;

a receiving member having a plurality of anchor members extending into the precast concrete panel, wherein at least two anchor members of the plurality of anchor members define an anchor volume therebetween, wherein a lower end of the receiving member is proximate to the lower end of the precast concrete panel; and a hook bar positioned in the precast concrete panel proximate to and uncoupled from the receiving member, the hook bar comprising:

a body portion;

a first intermediate portion connected on a first end to a lower end of the body portion;

a first end portion connected to a second end of the first intermediate portion; and a second end portion spaced apart from the first end portion, wherein the first and second end portions are substantially parallel with the body portion, and wherein the first and second end portions form an open end that is oriented away from the receiving member.

2. The reinforcement system of claim 1, wherein the body portion is offset from a back surface of the receiving member.

3. The reinforcement system of claim 2, wherein the offset of the body portion from the back surface of the body portion from the back surface is between approximately 0 inch and half of a thickness of the precast concrete panel.

4. The reinforcement system of claim 1, wherein a lower end of the hook bar is offset from the lower end of the precast concrete panel.

5. The reinforcement system of claim 1, wherein the first intermediate portion has a curved shape and offsets the first end portion from the body portion.

6. The reinforcement system of claim 5, wherein the first intermediate portion has a constant radius of curvature.

7. The reinforcement system of claim 1, further comprising a second intermediate portion connected on a first end to an upper end of the body portion, wherein the second end portion is connected to a second end of the second intermediate portion.

8. The reinforcement system of claim 7, wherein the second intermediate portion has a curved shape and offsets the second end portion from the body portion.

9. The reinforcement system of claim 8, wherein the second intermediate portion has a constant radius of curvature.

10. The reinforcement system of claim 1, wherein the hook bar is positioned in the precast concrete panel, and the body portion of the hook bar is at least partially extending through the anchor volume.

* * * * *